United States Patent [19]

Gilbrech

[11] 4,026,182

[45] May 31, 1977

[54] TUNING PEG

[76] Inventor: Donald A. Gilbrech, 1302 Beechwood Ave., Fayetteville, Ark. 72701

[22] Filed: Apr. 15, 1976

[21] Appl. No.: 677,422

[52] U.S. Cl. ..... 84/305

[51] Int. Cl.[2] ..... G10D 3/14

[58] Field of Search ..... 84/304, 305, 306

[56] References Cited

UNITED STATES PATENTS

| | | | |
|---|---|---|---|
| 1,672,348 | 6/1928 | Sharpe | 84/304 |
| 1,802,937 | 4/1931 | Bertram | 84/304 |
| 3,459,092 | 8/1969 | Thompson | 84/305 |
| 3,726,172 | 4/1973 | Sorkin | 84/304 |

*Primary Examiner*—Stephen J. Tomsky
*Attorney, Agent, or Firm*—Head, Johnson & Chafin

[57] ABSTRACT

A tuning peg for a musical instrument such as a banjo, guitar, or the like in which the tone of the string is determined by the tension thereon, the tuning peg having two coaxial parts with inclined surfaces therebetween so that as the string tends to rotate the tuning peg, the inclined surfaces push the portions apart, causing increased frictional contact, which in turn resists rotation. In addition, a gear linkage within the tuning peg multiplies the effect of the torque which further resists rotation by the taut string.

7 Claims, 3 Drawing Figures

TUNING PEG

BACKGROUND AND OBJECTS OF THE INVENTION

Tuning pegs have been employed from the invention of string instruments centuries ago. In the simplest embodiment a tuning pin is a tapered piece of wood which fits in a tapered hole in the neckpiece of the musical instrument, the frictional engagement between the pin and the hole serving to retain the string in its preselected taut position to produce the tonal quality desired.

In more recent years improvements have been made in tuning pegs as illustrated by U.S. Pat. Nos. 1,672,348; 1,669,824 and 3,726,172. The prior art revealed in these patents indicates the desire to design musical instruments in which the operator can more accurately and easily adjust the tension on the ring of a musical instrument and to more securely retain the preselected tension. These basic objects are also the objects of the present invention, that is, to provide a tuning peg which is more easily adjusted and which positively retains the tension adjustment.

These objects, as well as other and more specific objects of the invention will be fulfilled in the following description and claims, taken in conjunction with the attached drawings.

DESCRIPTION OF VIEWS

SUMMARY OF THE INVENTION

A tuning peg is provided for adjustably tensioning the strings of a musical instrument such as a banjo, guitar, or the like. A cylindrical housing is employed having a large diameter opening at one end and a coaxial smaller diameter opening at the other and providing an internal shoulder. A cylindrical shaft having an integral enlarged diameter coaxial collar is received in the housing small diameter opening, the collar frictionally engaging the housing internal shoulder. A cylindrical thrust member is coaxially supported adjacent the shaft and is rotatably coupled to it, the one end of the thrust member having an end surface in the form of sawtooth shaped teeth. An axially positioned cylindrical capstan has a reduced diameter peg portion on one end and on the other end a cylindrical portion having sawtooth shaped circumferential teeth of the same slope and dimensions as the teeth on the thrust member, the teeth being in engagement with each other. A capstan retainer has an opening therein receiving the capstan and securing it in relation to the thrust member, the inclined surfaces of the thrust member serving, when the capstan is rotated in a direction opposite that utilized to tension the string to provide axial thrust against the thrust member to thereby increase the frictional engagement of the shaft collar with the housing internal shoulder to resist rotation of the capstan. An adjusting knob may be attached to the shaft to provide means for manually positioning the capstan.

DETAILED DESCRIPTION

Figure 1:
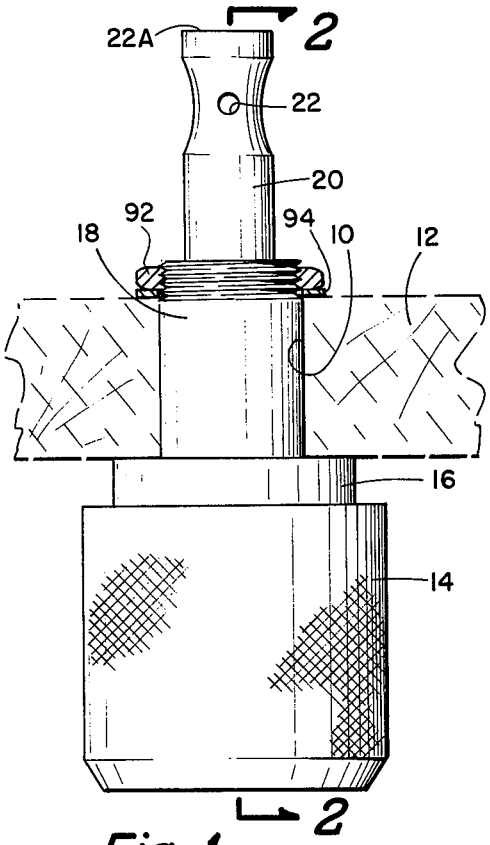
FIG. 1 is an external view of a tuning peg employing the principles of this invention.

Referring to the drawings and first to FIG. 1 an elevtional view of a tuning peg is shown. The peg is shown as it is received in an opening 10 in the keyboard portion 12 normally a part of the outer end of the neck of a musical instrument, such as a banjo, guitar or the like. The external parts of the tuning peg shown in FIG. 1 include an adjusting knob 14, a housing 16, a capstan retainer 18, and the upper end of a capstan 20. The capstan includes an opening 22 therein through which the end of a string (not shown) may be received. By the rotational positioning of capstan 20 the tension on the string of the musical instrument is obtained. When the instrument is tuned and in order to maintain the tune of the string the capstan must not rotate backwards in response to the tension of the spring but maintain the same rotational position indefinitely.

Figure 2:
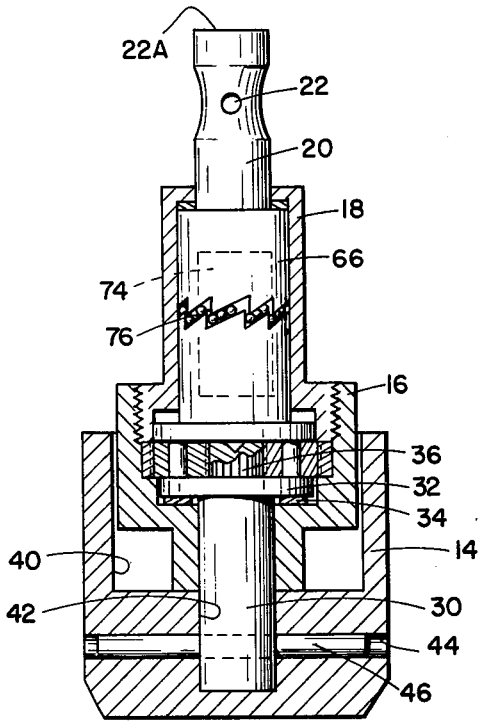
FIG. 2 is a cross-sectional view taken along the line 2—2 of FIG. 1.
Figure 3:
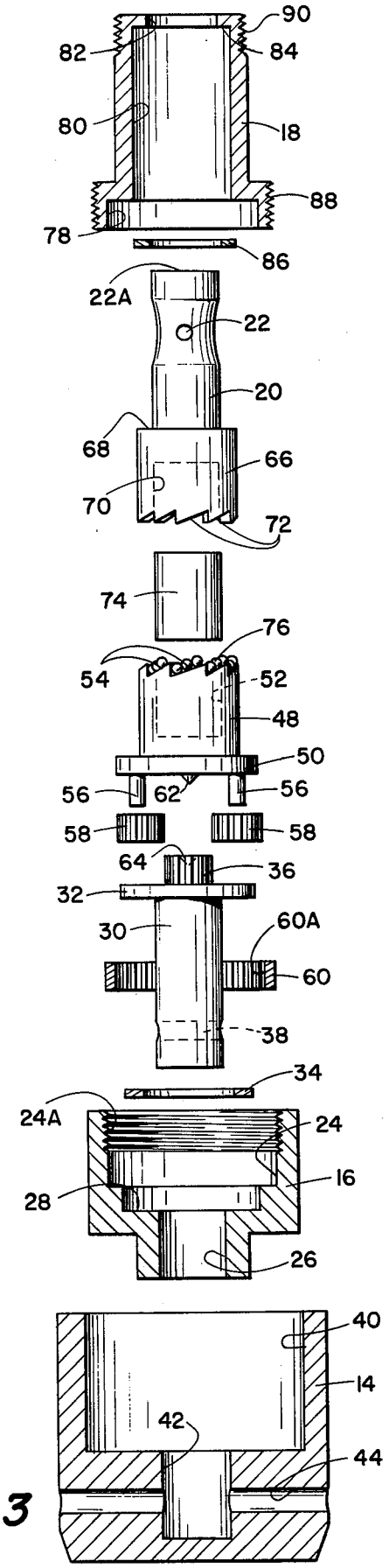
FIG. 3 is an expanded cross-sectional view of the elements making up the tuning peg as shown in FIGS. 1 and 2.

Referring to FIGS. 2 and 3 the internal arrangement and more details of the components making up the tuning peg are shown. The cylindrical housing 16 has an enlarged diameter opening 24 in one end and a coaxial smaller diameter opening 26 in the other, the juncture of openings 24 and 26 providing an internal shoulder 28. The upper end of internal opening 24 is threaded at 24A.

A shaft 30 is rotatably received in smaller diameter opening 26 of the housing 16. Adjacent the first end of shaft 30 is an enlarged diameter integral coaxial collar 32. A thrust washer 34 is received on shaft 30 and is positioned between collar 32 and the housing internal shoulder 28. At the first end of shaft 30 is an integral sun gear 36. A perpendicular opening 38 is provided in the second end of shaft 30.

Adjusting knob 14 has a knurled exterior surface to facilitate manual positioning thereof or it may be configured with any other external surface to facilitate manual rotation so that the user of the musical instrument employing the tuning peg may easily adjust the tension on a string. Adjusting knob 14 has an internal enlarged diameter opening 40 at one end which rotatably receives housing 16 and a smaller diameter opening adjacent the other end which receives shaft 30. A perpendicular opening 44 in the lower end of the adjusting knob intersects opening 42. A key 46 is positioned in openings 44 and 38 to rotatably lock the adjusting knob to the shaft. Opening 44 may be threaded and a set screw (not shown) used in place of key 46.

A thrust member 48 has an integral collar 50 at the lower end and a cylindrical coaxial recess 52 at the upper end. The upper cylindrical end surface of the thrust member 48 is configured with a series of inclined surfaces 54 so as to form a sawtooth configuration. The lower end of the thrust member 48 has one or more shafts 56 depending downwardly. Two shafts 56 are illustrated although three may be employed. Received on each shaft 56 is a planetary gear 58. A ring gear 60 having circumferential internal teeth 60A is press fitted into the larger diameter opening 24 of housing 16. The planetary gears 58 engage sun gear 36 and ring gear 60 so that a mechanical advantage is imparted to the rotational relationship between shaft 30 and thrust member 48. The exact mechanical relationship is dependent upon the size of the gears, but in the illustated proportions a relationship of about four to one is obtained. That is, four revolutions of shaft 30 obtained by manual rotation of adjusting knob 14 will produce one revolution of thrust member 48.

An integral coaxial conical projection 62 is provided on the lower surface of the thrust member collar portion 50. A similarly configured recess 64 is formed in the upper end of gear 36. In the assembled relationship the projection 62 imparts thrust from the thrust member 48 to shaft 30. The thickness of planetary gears 58 is less than the spacing between collars 32 and 50 so that the planetary gears 58 are freely rotatable on shafts 56.

Capstan 20 has a reduced diameter upper portion which is seen in FIG. 1 and an enlarged diameter lower portion 66, as seen in FIGS. 2 and 3, providing a shoulder 68. The lower end of the capstan lower portion 66 has a coaxial recess 70 therein of diameter the same as recess 52 in thrust member 48. The lower surface of portion 66 has a series of inclined surfaces 72 forming a sawtooth configuration, the inclination of the surfaces 72 being the same as that of surfaces 54. A cylindrical alignment pin 74 is received in recess 52 and 70 so that the capstan and thrust members are maintained in alignment. Positioned between the inclined surfaces 54 and 72 are bearings 76.

The capstan retainer 18 is formed by three coaxial interior openings the lower opening 78 being of the largest diameter and of sufficient size to freely rotatably receive collar 50 formed on the lower end of thrust member 48; the intermediate opening 80 being of a dimension to freely rotatably receive portion 66 of capstan 20; and the smallest diameter upper opening 82 being of a size to freely rotatably receive the upper reduced diameter portion of capstan 20. The difference in diameter between openings 80 and 82 provides an internal shoulder 84. Positioned on the capstan 20 is a thrust washer 86 which is thereby positioned between the capstan shoulder 68 and the capstan retainer internal shoulder 84. The lower end of the capstan retainer 18 is provided with external threads 88 which engage the internal threads 24A of housing 16.

The tuning peg is assembled by positioning the members together as illustrated in FIG. 2. Ring gear 60 is pressed into the opening 24 in housing 16. Only two locking actions are required, that is, the threading of the capstan retainer 18 into housing 16 after the elements are assembled, and the placing of pin 46 through the adjusting knob 14 and shaft 30.

The upper end of capstan retainer 18 has external threads 90. By means of nut 92 and washer 94 (see FIG. 1) the capstan retainer is secured in opening 10 of instrument key board 12.

OPERATION

The tuning peg is used to tighten a string by the rotation of the capstan 20 in the clockwise direction looking down on the end 22A of the capstan. To rotate the capstan the user rotates the adjusting knob 14 which in turn rotates shaft 30. This in turn rotates the sun gear 36 and the planetary gear 58 which reacts with the ring gear 60 to rotate the thrust member 48, the thrust member being rotated at an angular ratio of about one turn to each four turns of adjusting knob 14. This rotation is coupled by way of the inclined surfaces 54, bearings 76 and inclined surfaces 72 to capstan 20 thereby tightening the string to the desired tension.

With the string in tension there is applied a force tending to rotate the capstan 20 in the counterclockise direction. The tuning peg must resist this rotational force to maintain the proper tune of the string. As rotational force is applied to capstan 20 the inclined surfaces 72 react against bearings 76 and surfaces 54 on the thrust member, exerting a longitudinal force between the capstan 20 and the thrust member 48, tending to push these members apart. This longitudinal force is applied to thrust member washers 34 nd 86, causing frictional resistance to the rotation of capstan 20. It can be seen that the relationship of the inclined surfaces 54 and 72 apply thrust in both directions to resist rotation of the elements making up the tuning peg. At the same time, when the capstan 20 tends to rotate in the counterclockwise direction the rotation is applied to the thrust member 48 and by way of planetary gears 58 to the sun gear 64 and ring gear 60. The mechanical ratio achieved by the planetary gear system multiplies the effect of the friction on collar 32 by a ratio depending upon the gear arrangement, such as four to one. This, coupled with the increased frictional engagement against washers 34 and 86 caused by the inclined surfaces 72 and 74 assures that the tuning peg is highly resistive to reverse rotational torque.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A tuning peg comprising:

a cylindrical housing having an axial large diameter opening at one end and a coaxial smaller diameter opening at the other, the juncture of the openings providing an internal shoulder;

a cylindrical shaft having adjacent the first end an integral enlarged diameter coaxial collar, the portion adjacent the second end of the shaft being rotatably received in said housing smaller diameter opening, the diameter of said collar being less than said larger diameter opening of said housing and said collar being rotatably received in said housing, one surface of the collar frictionally engaging said housing internal shoulder;

a cylindrical thrust member coaxially supported adjacent said shaft first end and having means at its first end for rotationally coupling to said shaft, the thrust member having at the second end at least a portion of the end surface inclined to the cylindrical axis;

a cylindrical capstan having a reduced diameter peg portion at the first end to receive and wind the string of a musical instrument thereabout, the portion at the second end being of a diameter of said thrust member second end providing a shoulder between the outer portions, the capstan having at the second end at least a portion of the end surface inclined to the cylindrical axis, the capstan being supported coaxially with said thrust member and having the inclined surface thereof in engagement with said inclined surface of said thrust member; and a capstan retainer having an inner opening rotatably receiving said capstan second end and a reduced diameter coaxial outer opening receiving said capstan peg portion, the capstan retainer having an inner shoulder frictionally engaging said capstan shoulder whereby as said capstan is rotated the inclined surfaces thereof react against the inclined surface of said thrust member which tends to force the capstan and thrust member away from each other causing increased frictional engagement of said shaft collar with said housing internal shoulder and said capstan shoulder with said capstan retainer inner shoulder.

2. A tuning peg according to claim 1 including:

a thrust washer between said shaft collar and said housing shoulder.

3. A tuning peg according to claim 1 including:

a thrust washer between said capstan shoulder and said capstan retainer inner shoulder.

4. A tuning peg according to claim 1 wherein said means at the first end of said thrust member for rotationally coupling to said shaft includes epicyclic gear train means.

5. A tuning peg according to claim 4 including:

a sun gear coaxially affixed to the first end of said shaft;

a ring gear received in and nonrotatably affixed to said housing large diameter opening, the ring gear being coaxial with and in the plane of said sun gear;

at least one planetary gear positioned between said sun gear and said ring gear; and a gear shaft extending from the outer end of said thrust member, the axis of the gear shaft being displaced from and parallel the thrust member axis, the gear shaft rotatably receiving said planetary gear.

6. A tuning peg according to claim 1 including:

bearings positioned between the inclined end surface of said capstan and the inclined end surface of said thrust member.

7. A tuning peg according to claim 1 including:

an adjusting knob having an opening therein receiving the outer end of said shaft, the adjusting knob being secured to said shaft and providing means of manually rotatably positioning said capstan.

* * * * *